US006397409B1

(12) United States Patent
Sherlock et al.

(10) Patent No.: US 6,397,409 B1
(45) Date of Patent: Jun. 4, 2002

(54) BATH LIFTING SYSTEM

(75) Inventors: Mary F. Sherlock, Kerrville; Rainer Kuenzel, Hunt; John R. Schubert, Kerrville, all of TX (US)

(73) Assignee: Freedom Bath, Inc., Kerrville, TX (US)

( * ) Notice: Subject to any disclaimer, the term of this patent is extended or adjusted under 35 U.S.C. 154(b) by 0 days.

(21) Appl. No.: 09/550,307

(22) Filed: Apr. 14, 2000

(51) Int. Cl.[7] ..... A47K 3/02

(52) U.S. Cl. ..... 4/560.1; 4/561.1; 4/562.1; 4/563.1; 4/564.1; 4/565.1; 4/566.1; 4/604

(58) Field of Search ..... 4/560.1–566.1, 4/571.1, 573.1, 578.1, 579, 604

(56) References Cited

U.S. PATENT DOCUMENTS

| | | | | |
|---|---|---|---|---|
| 1,934,117 A | | 11/1933 | Daley et al. | 4/185 |
| 2,087,286 A | | 7/1937 | Hicks | 4/185 |
| 2,361,474 A | | 10/1944 | Gross | 4/185 |
| 2,494,224 A | * | 1/1950 | Benson | 4/566.1 |
| 2,672,620 A | | 3/1954 | Gross | 4/185 |
| 2,697,475 A | | 12/1954 | Dueth | 155/36.5 |
| 2,772,721 A | | 12/1956 | Saunders | 155/36.5 |
| 3,022,518 A | | 2/1962 | Hayden | 4/185 |
| 3,071,779 A | | 1/1963 | Turner | 4/185 |
| 3,078,475 A | | 2/1963 | Turner | 4/185 |
| 3,106,723 A | | 10/1963 | Carpenter | 4/185 |
| 3,203,008 A | | 8/1965 | Murcott | 4/185 |
| 3,280,409 A | | 10/1966 | Cotner | 4/185 |
| 3,289,217 A | | 12/1966 | Glover | 4/185 |

(List continued on next page.)

FOREIGN PATENT DOCUMENTS

| | | | | |
|---|---|---|---|---|
| DE | 3511-267 A1 | | 3/1985 | A47K/3/02 |
| EP | 0 198 946 A2 | | 10/1986 | |
| EP | 0 198 946 B1 | | 10/1986 | |
| GB | 2 117 236 A | | 10/1983 | |
| GB | 2131291 A | * | 6/1984 | |
| GB | 2-242-126 A | | 9/1991 | A47K/3/022 |
| GB | 2-248-547 A | | 4/1992 | A47K/3/12 |
| WO | WO 91/05530 A1 | | 5/1991 | |
| WO | WO 95/27464 A1 | | 10/1995 | |

OTHER PUBLICATIONS

*Home Health: Bathroom: Bath Lifts: Merlin Bathlifter–folding bathlift*; ©1997–2001 Westons Internet, 4 pages, http:/www.westons.com, last modified Oct. 14, 2001.

*Bath Lift*, Silver Cross Elevators, 2 pages, http:/www.silvercross.com/Products/BathLift.html, Copyright 1999.

*Free bathlifts, bath lifts information*, Silver Cross, 2 pages, http:/www.silvercross.com/Products/BathLift.htm, Copyright 1999.

(List continued on next page.)

*Primary Examiner*—Gregory L. Huson
*Assistant Examiner*—Tuan Nguyen
(74) *Attorney, Agent, or Firm*—Akin, Gump, Strauss, Hauer & Feld, L.L.P.

(57) ABSTRACT

A bath lift system comprises a seat which is raised and lowered inside of a bath by a lifting device positioned inside the bath. The lifting device provides an aesthetically appealing system with the seat substantially concealing the lifting device, thus obscuring its view. The lifting device reduces leakage while providing straight line movement positioning of the seat from a central position to a position along side of the top rim of the bath. Also, an alternative internal lifting device that eliminates the need for openings through the wall of the bath is provided.

27 Claims, 10 Drawing Sheets

U.S. PATENT DOCUMENTS

| | | | | |
|---|---|---|---|---|
| 3,307,204 | A | 3/1967 | Cotner | 4/185 |
| 3,317,928 | A | 5/1967 | Root | 4/185 |
| 3,381,317 | A | 5/1968 | Daniels et al. | 4/185 |
| 3,674,308 | A | 7/1972 | Radding | 297/345 |
| 3,714,672 | A | 2/1973 | Condon | 4/185 L |
| 3,918,108 | A | 11/1975 | Feyerherm | 4/185 |
| 4,569,091 | A | 2/1986 | Brandenberger | 4/562 |
| 4,628,550 | A | 12/1986 | Walton | 4/560 |
| 4,726,081 | A | 2/1988 | Duffin et al. | 4/564 |
| D297,876 | S | 9/1988 | Nolan | |
| RE33,624 | E | 7/1991 | Duffin et al. | 4/564 |
| 5,129,112 | A | 7/1992 | Schaffer | 4/560.1 |
| 5,146,638 | A | 9/1992 | Richards | 4/562.1 |
| 5,226,183 | A | 7/1993 | Clark | 4/560.001 |
| 5,263,207 | A | 11/1993 | Gilbert | 4/562.1 |
| 5,279,004 | A | 1/1994 | Walker | 4/563.1 |
| 5,329,651 | A | 7/1994 | Mardero et al. | 4/605 |
| 5,365,618 | A | 11/1994 | Gilbert | 4/563.1 |
| 5,396,670 | A | 3/1995 | Firebaugh et al. | |
| 5,530,975 | A | 7/1996 | Firebaugh et al. | |
| 5,537,697 | A | 7/1996 | Parker | 4/563.1 |
| 5,606,751 | A | 3/1997 | Baker | 4/560.1 |
| 5,797,149 | A | 8/1998 | Mustarde | |
| 5,813,062 | A | 9/1998 | Vago et al. | |
| 5,822,809 | A | 10/1998 | Gallo | 4/578.1 |
| 5,924,147 | A | 7/1999 | Clark et al. | 4/562.1 |

OTHER PUBLICATIONS

*Bath Lift Carexa*, Unicare Medical Inc. ad, one page; Unicare Medical Inc.; 770 Lawrence Ave. West; Toronto, Ontario M6A 1B8; Canada; 416–785–5535; 800–668–2030; 416–787–8042 (Fax); E–mail unicare@tube.com; www.unicaremedical.com.

*VersaBathSeat*™, ©2001 Chattanooga Group, Inc., catalog ad, 2 pages.

*The Intelligencer, Careva Bath Lift*, Battery Operated, one page; http://intelligenceraucitioncentral.com/ItemDemo.asp-?ProductNumber=10 Copyright 2000.

*Invacare, Model 5000*, Bed, one page; http://www.altamobility.com/chairs.html.

*PCT Search Report*, International Application No. PCT/US01/08819, 2 pages (Aug. 21, 2001).

Dialog Patent Search Report, http://www.dialogweb.com/cgi/dwclient, ©2001 The Dialog Corporation plc, 5 pages (Jul. 17, 2001).

Dialog Patent Search Report, http://www.dialogweb.com/cgi/dwclient, ©2001 The Dialog Corporation plc, 18 pages (Jul. 23, 2001).

Dialog Patent Search Report, http://www.dialogweb.com/cgi/dwclient, ©2001 The Dialog Corporation plc, 11 pages (Jul. 17, 2001).

*Operating Instructions and Parts List*, Neptune Bath Lift, Mountway, Ltd., issue 3, 9 pages (Mar. 5, 1991).

*Sunrise Medical's Home Page*, http://www.sunrisemedical-.com/sunrise.html, 1 page, printed on Feb. 21, 2001, date of first publication unknown.

*Sunrise One Source*, Sunlink Web . . . /listCatalogItems-?search=Hoyer&pointer=25&brand=&Category=&Attrl=&Attr2=&Attr3=&/2/21/01, 1 page, printed on Feb. 21, 2001, date of first publication unknown.

*Item Details* (*ITEMDETAILCALICO/productdetail.txt*), Sunrise One Source, h . . . /itemDetailCalico?item=040–0117AC&brand=&Category=&Attrl=&Attr2=&Attr3=&Attr4, 1 page, printed on Feb. 21, 2001, date of first publication unknown.

*Technical Specifications Item#040–117AC*; Sunrise One Source, Water Powered Tublift, 1 page, date of first publication unknown.

*Part Information* (*GETParts*), Sunrise One Source, . . . /getParts?item=040–0117AC&desc=Water%20Powered%20Tublift%20with%20Arm–Mounted2/21/01; 2 pages, date of first publication unknown.

[See—AAA] *Sunrise Medical's Home Page*, http://www-.sunrisemedical.com/sunrise.html, 1 page, printed on Feb. 27, 2001, date of first publication unknown.

[See—BBB] *Sunrise One Source*, Sunlink Web, . . . /Config Details?Varl–tublift&Var2=&Var3=&Var4=&Var5=&Var6=0&Var7=0&Var8=, 1 page, printed on Feb. 27, 2001, date of first publication unknown.

[See—CCC] *Search Results*, Sunrise One Source, . . . /searchDrawings?search=tublift&pointer=0&brand=&Category=&Attrl=&Attr2=&Attr3, 1 page, printed on Feb. 27, 2001, date of first publication unknown.

[See EEE] *040–0117 Water Powered Tublift*, Sunrise One Source, . . . /getDrawing?item=040–0117WW&name=040–0117~Water~Powered~Tublift &brand=&Cat Feb. 27, 2001; 2 pages, date of first publication unknown.

*Bath & Shower Systems*, The Arjo Architect's Tools, http://www.argo.com/GB–INT/pbashsys.htm, 2 pages, printed on Aug. 29, 2000, date of first publication unknown.

*Malibu*, The Arjo Architect's Tools, http://www.argo.com/Present/Malibu/intro.htm, 1 page, printed on Sep. 8, 2000, date of first publication unknown.

*Assisted Bathing, Integrated Transport/Bathing*, The Arjo Architect's Tools, http://www.arjo.com/Present/Malibu/ass1.htm, 1 page, printed on Sep. 8, 2000, date of first publication unknown.

*Assisted Bathing, Transferring the Chair*, The Arjo Architect's Tools, http://www.arjo.com/Present/Malibu/ass2.htm, 1 page, printed on Sep. 8, 2000, date of first publication unknown.

*Assisted Bathing, Adjusting The Bath Height*, The Arjo Architect's Tools, http://www.arjo.com/Present/Malibu/ass3.htm, 1 page, printed on Sep. 9, 2000, date of first publication unknown.

*Assisted Bathing, Washing Without Strain*, The Arjo Architect's Tools, http://www.arjo.com/Present/Malibu/ass4.htm, 1 page, printed on Sep. 8, 2000, date of first publication unknown.

*Product Specification*, The Arjo Architect's Tools, http://www.arjo.com/GB–INT/Malibu/prodspec.htm, 1 page, printed on Sep. 8, 2000, date of first publication unknown.

*Independent Bathing, Taking Control*, The Arjo Architect's Tools, http://www.arjo.com/Present/Malibu/indep2.htm, 1 page, printed on Sep. 8, 2000, date of first publication unknown.

*Space Requirements*, The Arjo Architect's Tools, http://www.arjo.com/GB–INT/Malibu/space.htm, 1 page, printed on Sep. 8, 2000, date of first publication unknown.

*Independent Bathing*, The Arjo Architect's Tools, http://www.arjo.com/Present/Malibu/indep.htm, 1 page, printed on Sep. 8, 2000, date of first publication unknown.

*Independent Bathing, Self Transfer*, The Arjo Architect's Tools, http://www.arjo.com/Malibu/indep1.htm, 1 page, printed on Sep. 8, 2000, date of first publication unknown.

*Assisted Bathing*, The Arjo Architect's Tools, http://www.arjo.com/Present/Malibu/ass.htm, 1 page, printed on Sep. 8, 2000, date of first publication unknown.

*Product Information*, ARJO Malibu, http://www.arjo.com/products/default.asp?Language=3&Category=23&Product=94, 1 page, printed on Feb. 11, 2001, date of first publication unknown.
*Installation Drawing*, ARJO Malibu, http://www.arjo.com/products/pdf/Malibu.pdf, 2 pages, printed on Feb. 11, 2001, date of first publication unknown.
*Product Specification*, ARJO Malibu, http://www.arjo.com/products/default.asp?Language=3&Category=23&Product=94Pa gel99, 1 page, printed on Feb. 11, 2001, date of first publication unknown.
*Product Information*, ARJO Freedom Bath, http://www.arjo.com/products/default.asp?Language=3&Category=23&Product=119, 2 pages, printed on Feb. 11, 2001, date of first publication unknown.
*Technical Information*, Arjo Freedom Bath, http://www.arjo.com/products/default.asp?Language=3&Category=23&Product=119 &Page=204, 2 pages, printed on Feb. 11, 2001, date of publication unknown.
*Installation Drawing*, ARJO Freedom Bath, http://www.arjo.com/products/pdf/Freedom.pdf, 7 page, printed on Feb. 11, 2001, date of first publication unknown.
*Product Information*, ARJO Prelude, http://www.arjo.com/products/default.asp?Language=3&Category=23&Product=121 , 1 page, printed on Feb. 11, 2001, date of first publication unknown.
*Installation Drawing*, ARJO Prelude, http://www.arjo.com/products/pdf/Prelude.pdf, 4 pages, printed on Feb. 11, 2001, date of first publication unknown.
*Product Specification*, ARJO Prelude, http://www.arjo.com/products/default.asp?Language=3&Category=23&Product=121 &Page=200, 1 page, printed on Feb. 11, 2001, date of publication unknown.
*Technical Information*, ARJO Prelude, http://www.arjo.com/products/default.asp?Language=3&Category=23&Product=121 &Page=206, 1 page, printed on Feb. 11, 2001, date of first publication unknown.

*Technical Information*, ARJO Malibu, http://www.arjo.com/products/default.asp?Language=3&Category=23&Product=94&Page=205, 4 pages, printed on Feb. 11, 2001, date of first publication unknown.

*Product Specification*, ARJO Malibu, http://www.arjo.com/products/default.asp?Language–3&Category–23&Product–94& Page–199, 1 page, printed on Feb. 11, 2001, date of first publication unknown.

The Arjo Architect's Tools, http://www.arjo.com/GB–INT/Freedom/front.htm, 1 page, printed on Aug. 29, 2000, date of first publication unknown.

Marshall Brain, *How Stuff Works, How Water Towers Work*, by Marshall Brain (5 pgs) ©1998 BYG Publishing, Inc. http://www.howstuffworks.com/water.htm.

University of Rhode Island Cooperative Extension, *Rhode Island Home *A* Syst Water Conservation Kit*, (3 pgs) Resources Science (printed Nov. 12, 1999) (no date for publication) http://www.edc.uri.edu/homeasyst/page10.htm.

*Guardian Tublift, Assembly, Installation and Operating Instructions*, Guardian Products (5 pgs) (no date).

American Stair–Glide Corporation, *Tubemate Bath Lift, Stop Worrying and Enjoy Your Bath Again*. (2 pgs) (no date but note 250 PM 1085—54R).

* cited by examiner 20
100
94
102
108
106
104
180
182
110
178
30
172
168
174
170
176
24A
22
22B
A
32
28
126
132
128
120
114
96
B
111
122
112
125
116
124
118
144
146
134
136
138
140
142
98
130

FIG. 8
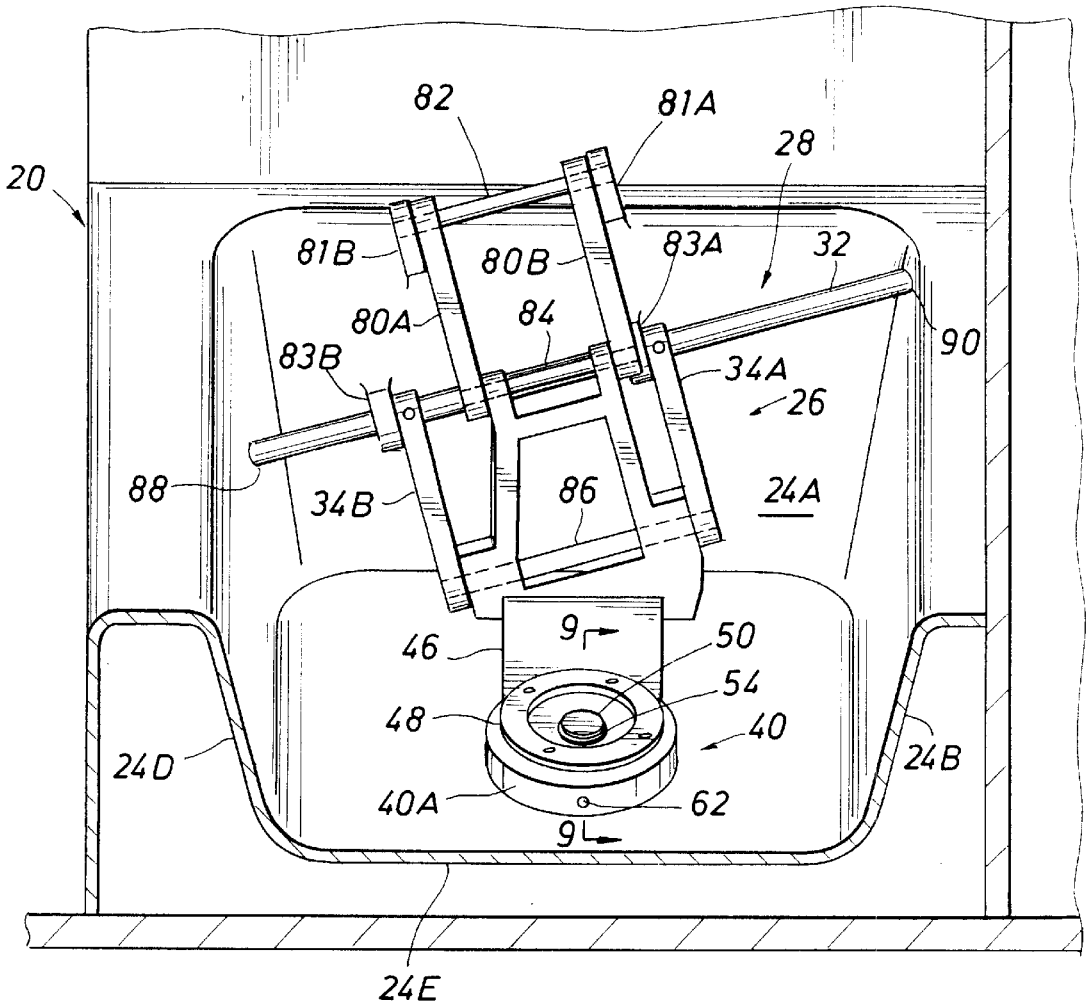
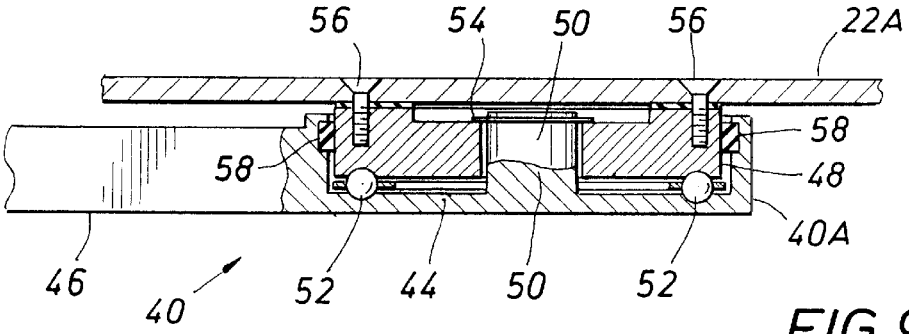
FIG. 9

BATH LIFTING SYSTEM

SPECIFICATION

CROSS-REFERENCE TO RELATED APPLICATIONS

Not applicable.

STATEMENT REGARDING FEDERALLY SPONSORED RESEARCH

Not applicable.

FIELD OF THE INVENTION

This invention relates generally to a bath system for raising and lowering an individual in and out of a bath, and more particularly, to a bath system with a seat and a lifting device, where the lifting device is positioned within the bath, substantially out of sight.

BACKGROUND OF THE INVENTION

Bath lifting systems have been available in the past to raise and lower individuals in and out of a bath. For example, U.S. Pat. No. 2,361,474 proposes a bath lifting system for raising and lowering an individual in and out of a bath using two exposed U-shaped crankshafts. A table spanning the shafts is connected to the bights of the U-shaped crankshafts. The crankshafts rotate in unison to rotate the table from a lowered position within the bath to a raised or extended position out of the bath.

Another bath lifting system is proposed in U.S. Pat. No. Re. 33,624. This system proposes a lifting device on the outside of the bath connected to a seat support member that extends through the bath wall. In particular, the seat support member extends through an elongated wall opening, or slot, to lift the seat from a lowered position to a raised position.

Yet another bath lifting system is proposed in U.S. Pat. No. 5,146,638. This system proposes a telescoping lifting column which is positioned in an upright position through one end of the upper rim of a bath. The lifting column includes a first actuator that vertically raises and lowers the seat in and out of a bath. A second actuator then swivels or rotates the lifting column about its cylindrical axis to position the front portion of the seat from a central position in the bath to a position over the rim of the bath. If desired, the seat can be swiveled through a smaller angle from its central position in the bath for transfer from a wheelchair to the seat.

Many other bath lift systems, available in the past, have an appearance that is bulky and mechanical. In particular, exposed lifting devices located adjacent to the bath are not considered aesthetically appealing. In the lifting devices positioned out of sight behind a side bath wall and extending through the upper rim of the bath, dual actuators, electronic circuitry and mechanical parts are proposed to provide a two step movement to first raise the seat and then swivel the seat, even if only to swivel the seat a preferred smaller angle from a central position to position the seat for transfer from a wheelchair. (See '638 patent, col. 3, In. 62 to col. 4, ln. 41). Also, support members which extend through an elongated opening or slot in the bath wall, that begin at the bottom of bath in the drain area, are particularly susceptible to seal wear and resulting water leakage from the area where fluids collect caused by the sliding movement of the member that extends through the wall.

Therefore, an aesthetically appealing lifting device, concealed behind the seat, would be desirable. Moreover, a lifting device substantially concealed behind a lift seat that reduces leakage while providing straight line movement positioning of the seat from a central position to a position along side of the rim of the bath for transfer from a wheelchair would be desirable.

SUMMARY OF THE INVENTION

According to the invention, a bath that substantially conceals the lifting device behind the seat and reduces leakage while providing straight line movement to position the seat from a central position to a position along the side of the rim of the bath for transfer from a wheelchair is disclosed.

BRIEF DESCRIPTION OF THE DRAWINGS

The object, advantages, and features of the invention will become more apparent by reference to the drawings which are appended hereto and wherein like numerals indicate like parts and wherein an illustration of the invention is shown, of which:

FIG. 8 is a perspective view of the preferred embodiment looking down, and towards the back of the bath, with the seat removed, to better illustrate the lifting device;

FIG. 9 is a view of the bath taken along line 9—9 of FIG. 8 showing a cross section view of the seat rotation assembly;

DETAILED DESCRIPTION OF THE PREFERRED EMBODIMENT

Figure 10:
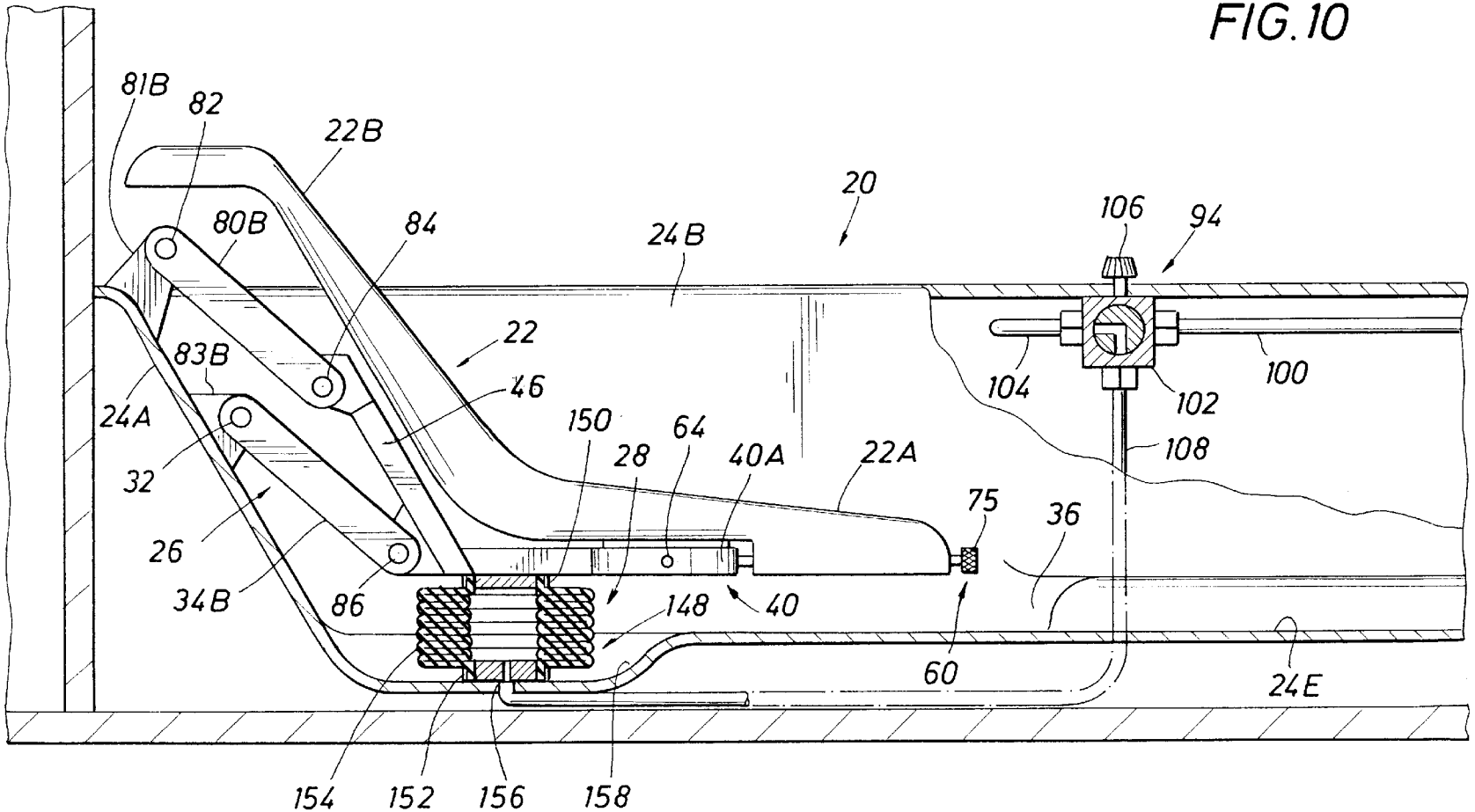
FIG. 10 is a cut-away side elevational view of an alternative embodiment A of the present invention showing the seat in the lowered position.
Figure 11:
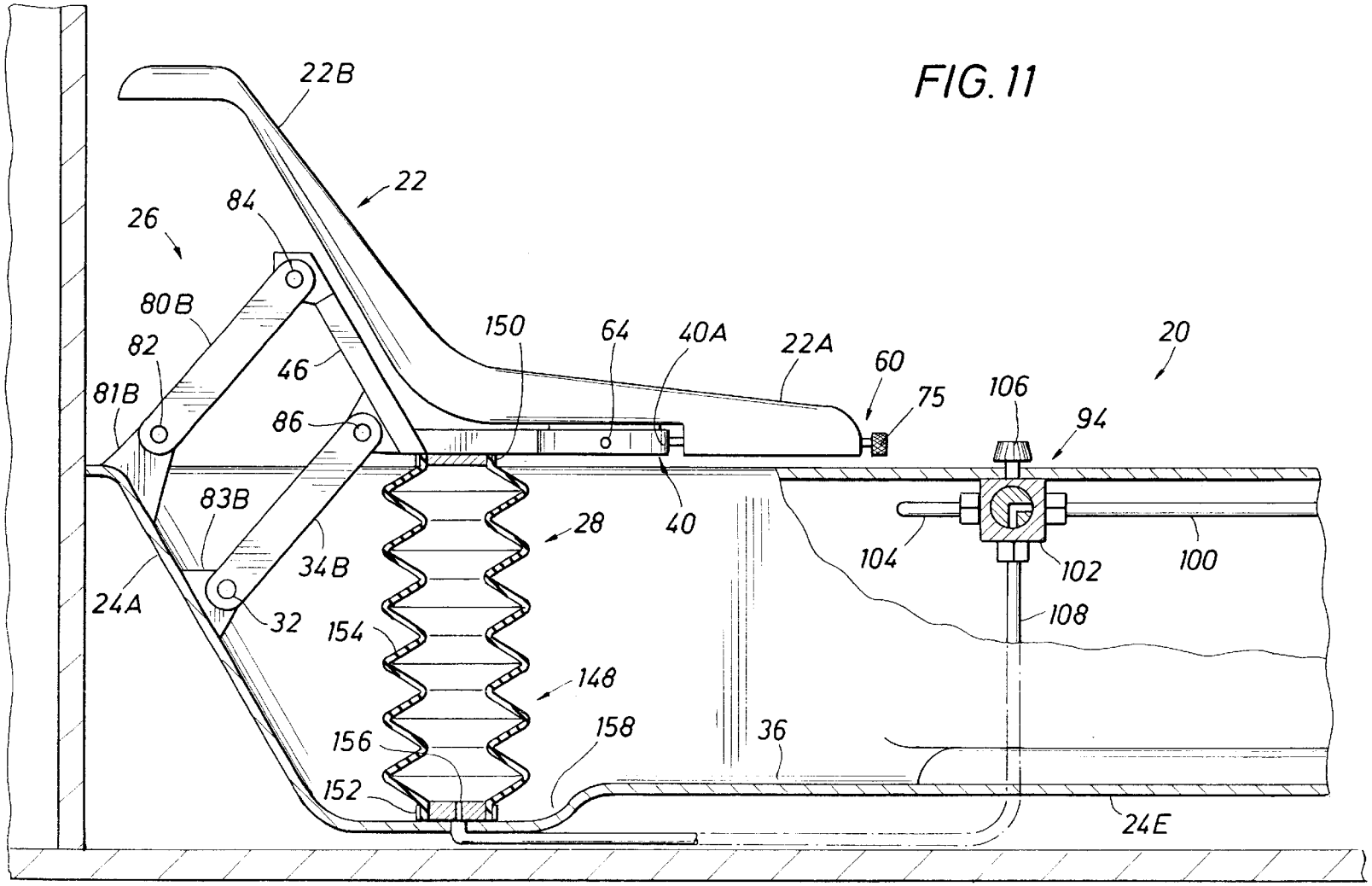
FIG. 11 is a view similar to FIG. 10 of an alternative embodiment A of the present invention showing the seat in the raised position.
Figure 12:
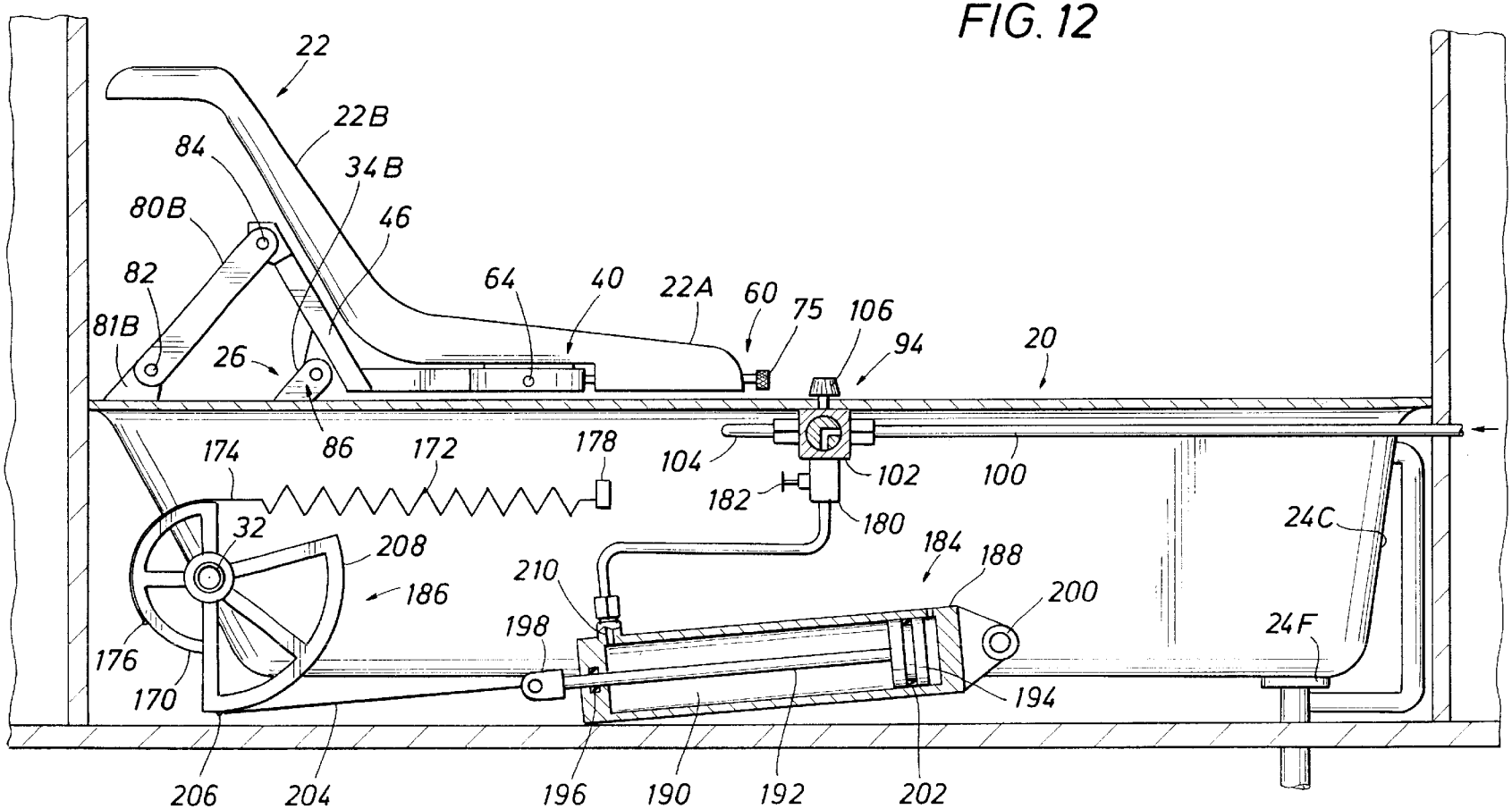
FIG. 12 is a side elevational view of an alternative embodiment B of the present invention showing the seat in the raised position.

The bath lift system of the present invention is shown in the Figures (FIGS.) In particular, the preferred embodiment of the bath lift system is shown in FIGS. 1–9 and alternative embodiments are shown in FIGS. 10–12.

The preferred embodiment comprises: a bath, generally indicated at 20, seat, generally indicated at 22, guiding assembly, generally indicated at 26, lifting device, generally indicated at 28, and lifting power system, generally indicated at 30. As shown in the Figures, bath 20 includes bath walls 24A, 24B, 24C, 24D, and bath bottom 24E, along with other standard bath features including openings 24F and 24G for drains. This preferred embodiment includes a seat recess 36 in the bath bottom 24E and channel recess 38 for communicating fluid from the seat recess 36 to the drain opening 24F. Other recess formations may be used or no recess formations could be used. Also, other embodiments may relocate standard bath features, such as the drain, or may modify standard bath features, for example, by using multiple drains. In addition, other embodiments may use a hot tub, pool, a whirlpool bath or shower in place of a bath.

Figure 1:
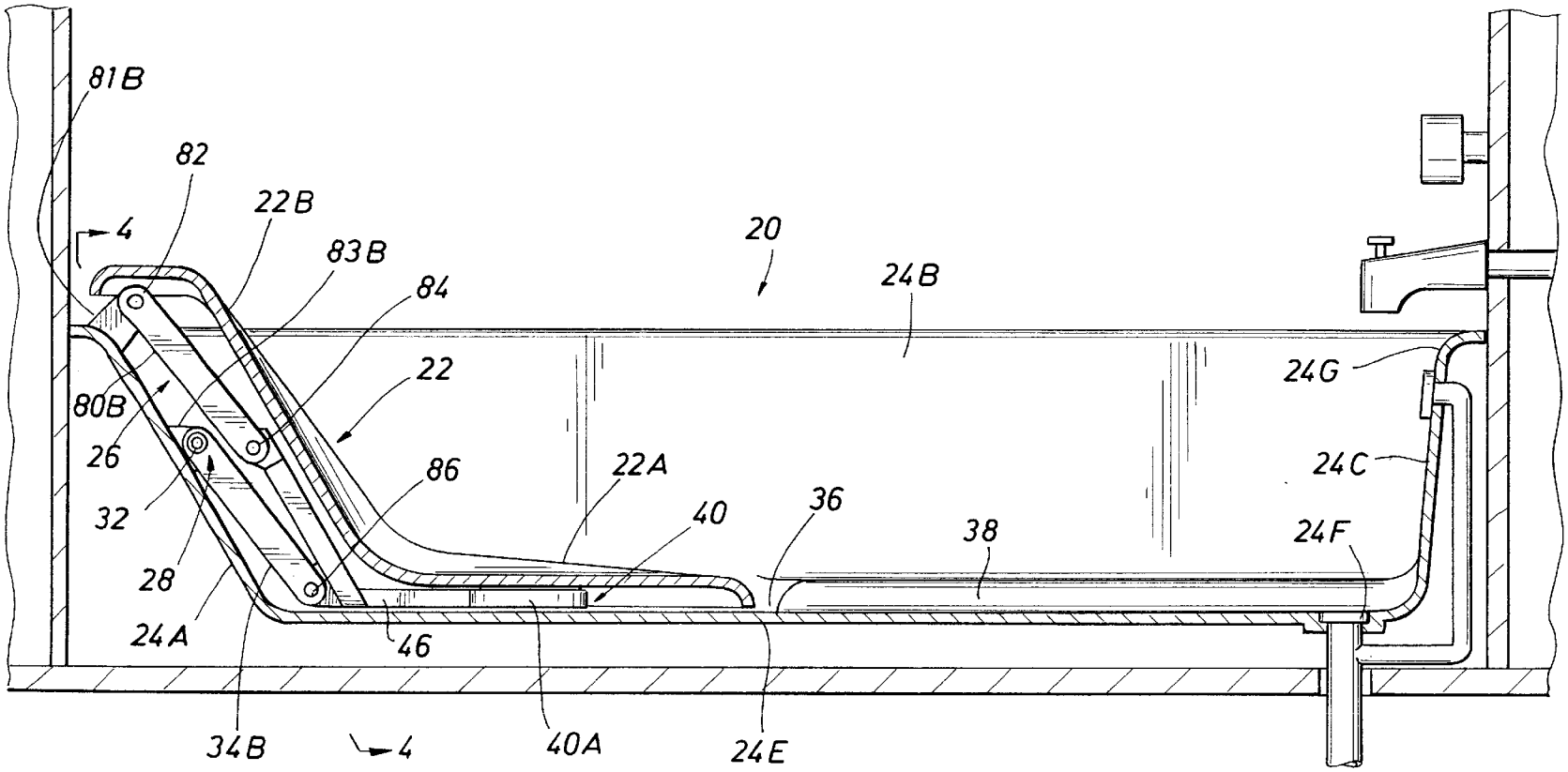
FIG. 1 is a cut-away side elevational view of the preferred embodiment of the bath lift system with the seat in the lowered position.
Figure 2:
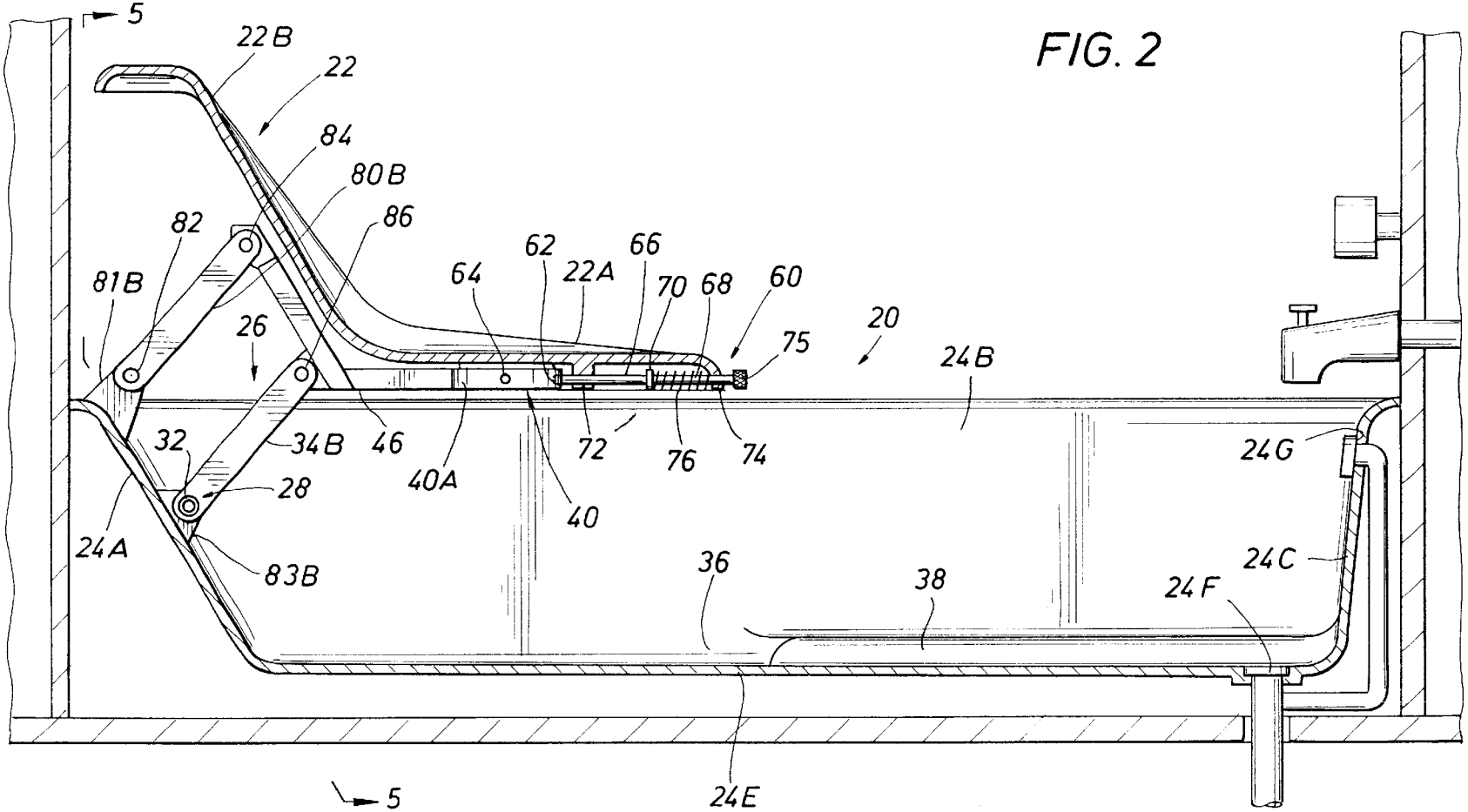
FIG. 2 is a view similar to FIG. 1 with the seat in the raised position.

Seat 22, preferably fabricated from a non-corrosive material such as plastic, can be seen in FIGS. 1–7. Seat 22 is sized and positioned to substantially obscure the view of both the guiding assembly 26 and the lifting device 28, when seat 22 is in the lowered position. As best shown in FIGS. 2, 8 and 9, seat 22 is rotatably attached to a seat rotation assembly, generally indicated at 40, via seat bottom 22A. As best shown in FIG. 9, seat bottom 22A is attached to rotor 48 of rotation assembly 40 by means of stainless steel bolts 56. Rotor 48 rotates about post 50 within housing 44 of rotation assembly 40 and is secured about post 50 via securing ring 54. Rotor 48 rotates within housing 44 contacting bearings 52 and bushings 58. Housing 44 is preferably integral with cantilevered seat bracket 46, which is in turn attached to guiding assembly 26. Other embodiments may not substantially obscure the view of guiding assembly 26, such as with an opening in seat back 22B. In addition, other embodiments may exclude rotation assembly 40 and directly fixedly attach the seat bottom 22A directly to the seat bracket 46.

Figure 3:
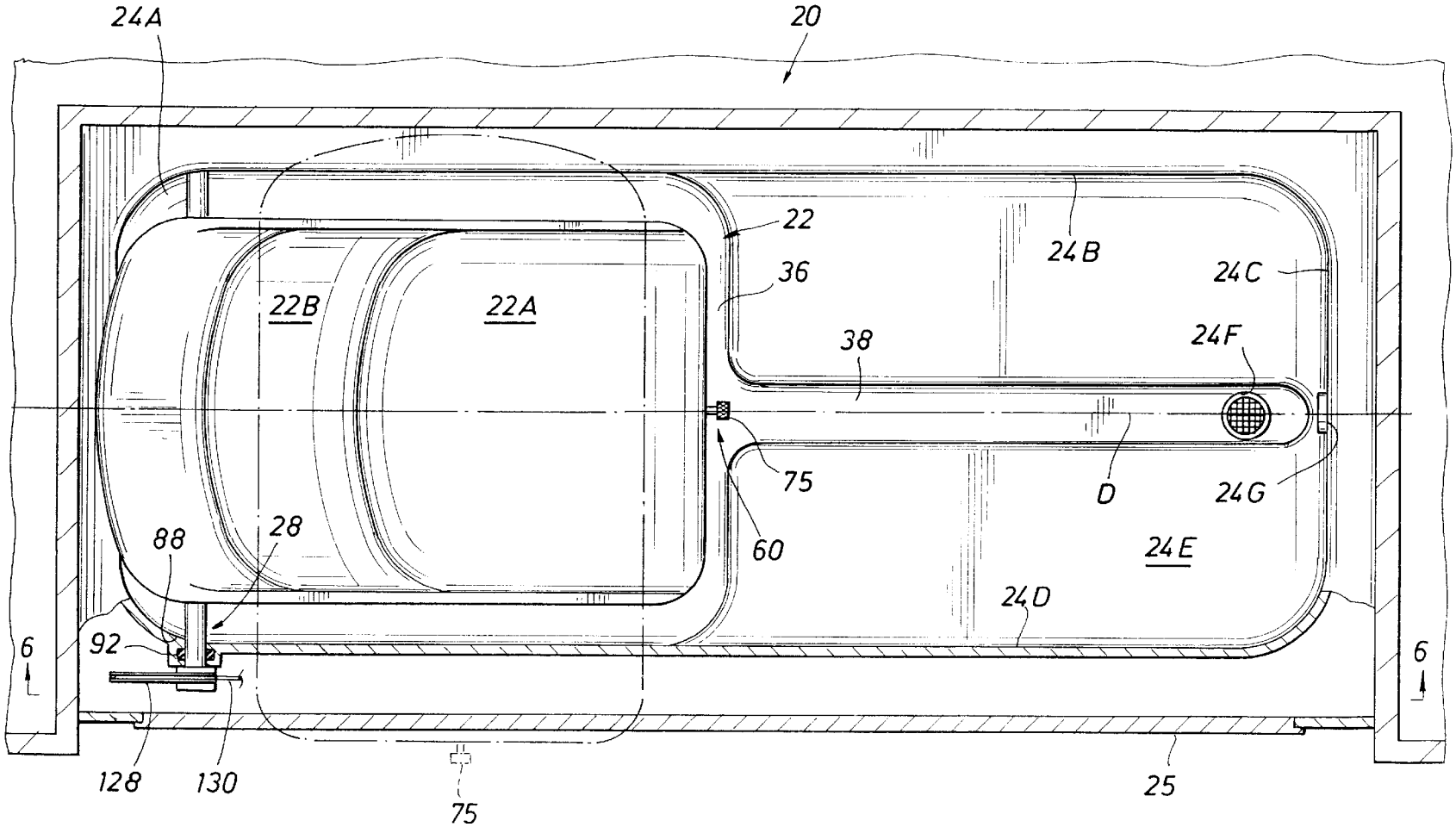
FIG. 3 is a top view of the bath lift system as shown in FIG. 1, with the seat also shown in phantom view in its rotated position.
Figure 5:
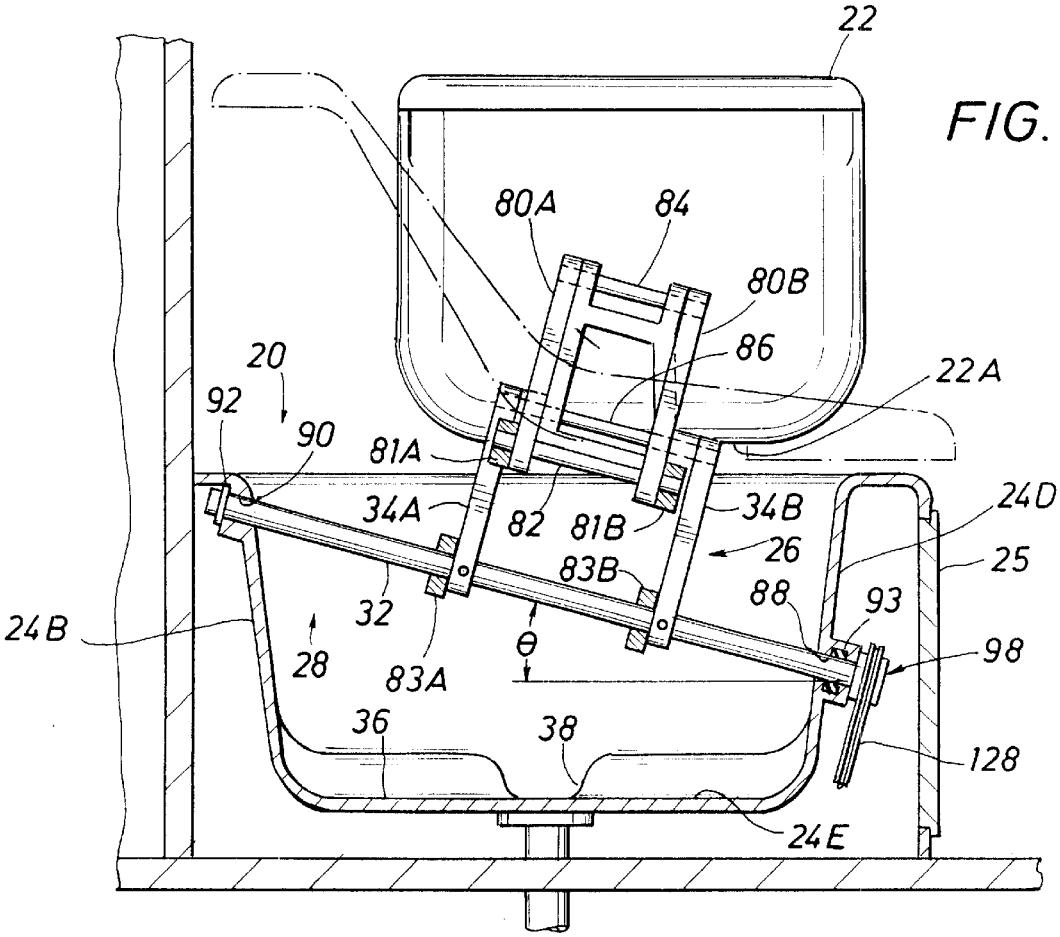
FIG. 5 is a view taken along line 5—5 of FIG. 2, with the seat alga sown in phantom view in its rotated position.

As best shown in FIGS. 2, 3 and 5, locking pin, generally indicated at 60, along with pin holes 62 and 64 in rotation assembly 40 are used to lock seat 22 into predetermined desired positions. Locking pin 60 has a pin head 75, a left and right (when viewing FIG. 2) shaft portions, 66 and 68, respectively, separated by collar 70 therebetween. Left shaft portion 66 extends through seat bottom extension 72. Right shaft portion 68 extends through seat bottom opening 74. Collar 70 is urged away from seat bottom opening 74 by a coil spring 76 compressed between collar 70 and seat bottom opening 74 to urge the end of locking pin 60 to contact the cylindrical exterior 40A and the desired pin holes 62 and 64 of rotation assembly 40. Locking pin hole 62, located on the front cylindrical exterior 40A of rotation assembly 40, is located in the rotation path of locking pin 60. When the desired pin hole is aligned with locking pin 60, coil spring 76 urges locking pin 60 to be received in selected pin hole to lock the seat in the desired position as shown in FIG. 2. Locking pin hole 64, preferably located 90° from hole 62 on the side of the cylindrical exterior 40A of rotation assembly 40, is also located in the rotational path of locking pin 60. When the locking pin 60 engages pin hole 64 the seat 22 is locked in the lateral position, as shown in phantom view in FIGS. 3 and 5. Other alternative embodiments may use other forms of locking mechanisms and locked positions.

Guiding assembly 26 of the preferred embodiment is best shown in FIGS. 1, 2, 4, 5, 7 and 8. In the preferred embodiment, the guiding assembly 26 is made up of first set of arms 34A and 34B and second set of arms 80A and 80B, and the entire assembly is mounted to wall 24A at an angle Ø, as best shown in FIG. 5, with respect to the bottom 24E of bath 20. The angle Ø at which the arms are attached is such that when the seat is in the lowered position, the seat is located substantially along the longitudinal axis D of the bath, as best shown in FIG. 3, and when the seat is in the raised position, the seat overlaps the top of the side wall 24D of the bath, as best shown in FIG. 5. In the preferred embodiment, both sets of arms are attached at one end to the bath wall 24A and at the other end to seat bracket 46. As best shown in FIGS. 1, 2, 4 and 5, the second set of arms 80A and 80B are pivotally attached at one end to upper wall rod 82 and at the other end to upper seat rod 84. Upper wall rod 82 is, in turn, attached to bath wall 24A via attachment blocks 81A and 81B. The first set of arms 34A and 34B are fixedly attached at one end to rotatable member 32, and, at the other end, to lower seat rod 86. Rotatable member 32 is attached to bath wall 24A via attachment blocks 83A and 83B. Other alternative embodiments may use a single first arm and a single second arm, and others only a structurally stable first set of arms, and yet others with only a single first arm. Also, other alternative embodiments may mount any existing first or second sets of arms horizontally, rather than at an angle Ø to the bottom of the bath. Other embodiments may not use rods that extend the fall width of the bath, but rather, only extend between the side of the bath and the connection arm(s). Yet even other alternative embodiments may utilize different types of guiding assemblies which transform rotational movement into vertical displacement of the seat.

Figure 4:
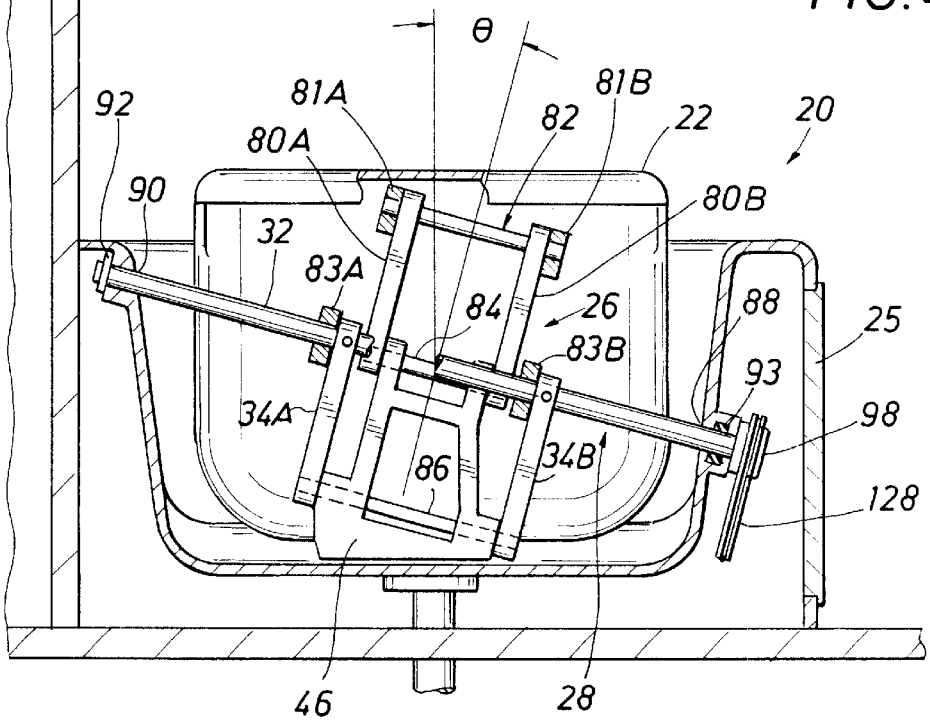
FIG. 4 is a view taken along line 4—4 of FIG. 1.

Lifting device 28 can best be seen in FIGS. 1, 2, 3, 4, 5, 6, 7, and 8. In the preferred embodiment, as best shown in FIGS. 4 and 5, the lifting device 28 is rotatable member or steel rod 32. The rod 32 is positioned in the bath 20 using lower wall opening 88, upper wall opening 90, washer 92, and rotatable member seal 93. The seal 93 is preferably fabricated from an elastomer, such as rubber. The rotatable member 32 preferably extends from upper wall opening 90 and through lower wall opening 88. Upper wall opening 90 is located above lower wall opening 88 such that rotatable member 32 is positioned at angle 0 with respect to the bottom 24E of bath 20. Washer 92 is positioned in bath wall 24D such that washer 92 aides the rotation of rotatable member 32 relative to wall opening 90. Rotatable member seal 93 sealing opening 88 provides a water tight seal about rotatable member 32. Since seal 93 surrounds cylindrical rod 32, the rotation of rod 32 about its cylindrical axis does not significantly distort the seal 93. Thus, the seal 93 is maintained under constant static pressure which is an advantageous condition for maintaining a good seal. Other embodiments may use upper wall rod 82 as the lifting device and in doing so may alleviate the need for seal 93 by locating the lowest wall opening above the water line of the bath. Leverage mechanism, generally indicated at 98, attaches to the portion of rotatable member 32 which extends though lower wall opening 88 to provide lifting device 28 its lifting force. Yet, other embodiments may use entirely different lifting devices, including such mechanisms which are not connected with the guiding assembly, or such mechanisms which require no proposed openings in bath walls 24, as discussed below in alternative embodiment A.

Figure 6:
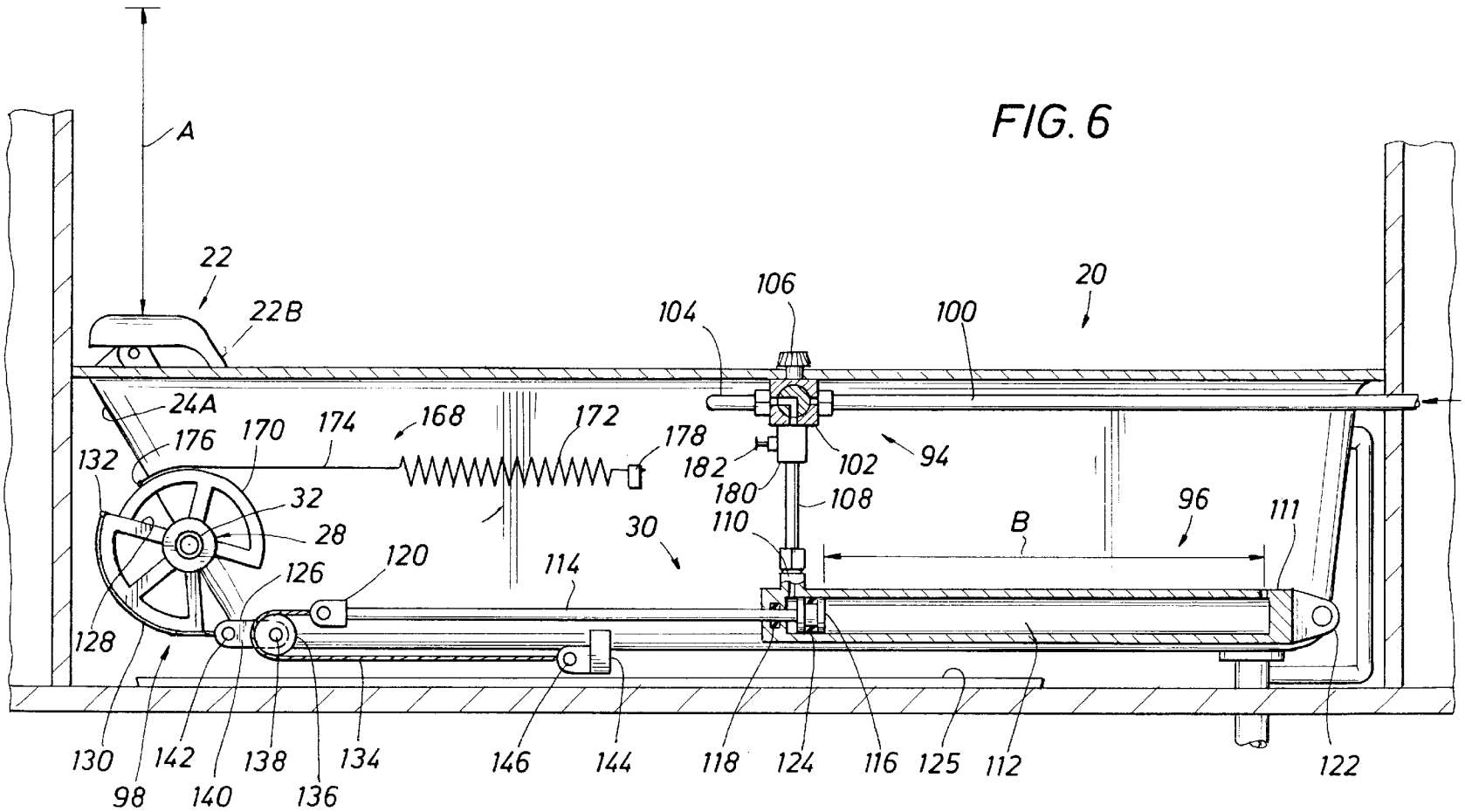
FIG. 6 is a side elevational view taken along line 6—6 of FIG. 3 showing the lifting power system of the preferred embodiment.
Figure 7:
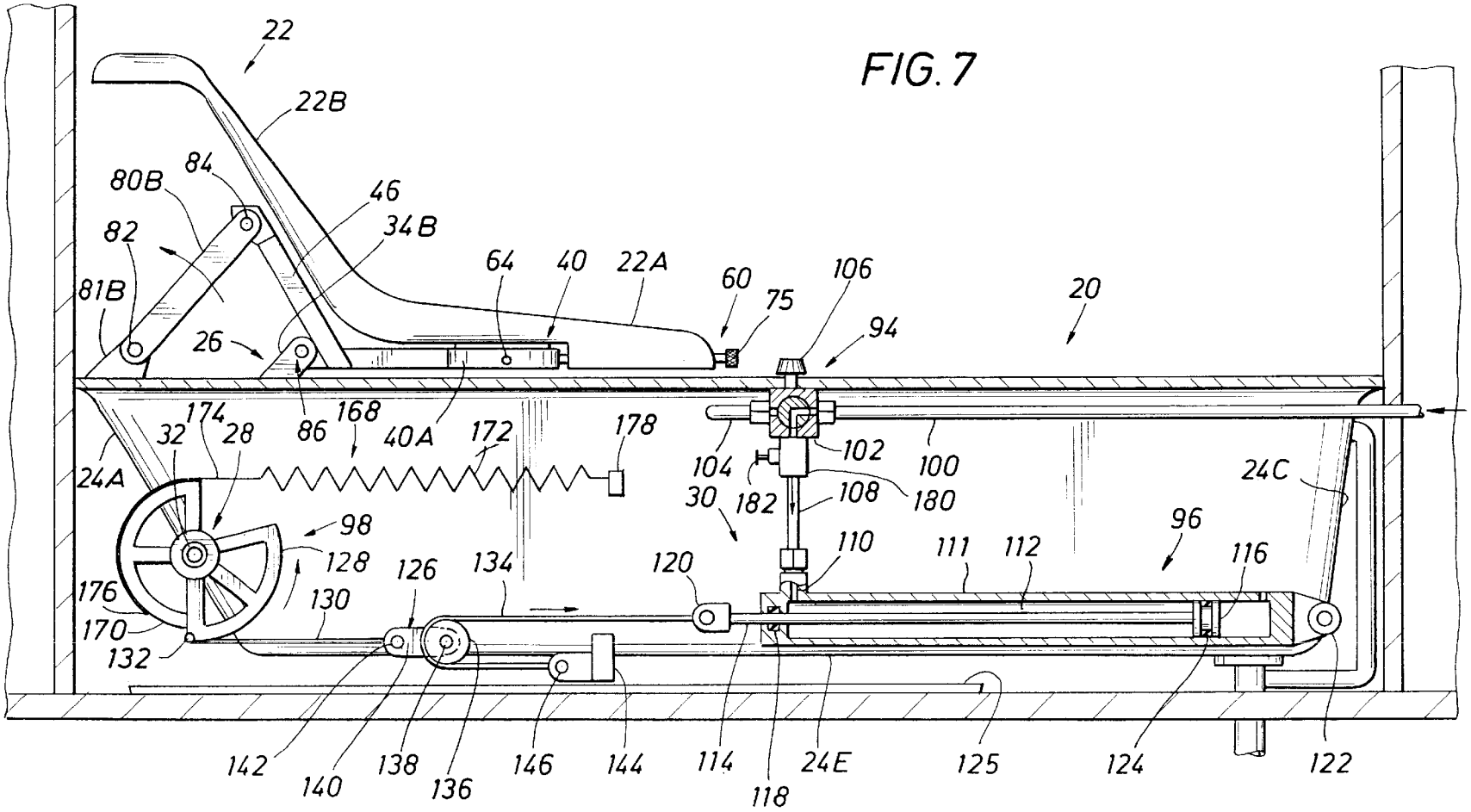
FIG. 7 is a side elevational view, similar to FIG, 6, showing the seat in the raised position.

A preferred lifting power system 30 is best shown in FIGS. 6 and 7. The lifting power system 30 has the following four components: a fluid control system, generally indicated at 94, a drive system, generally indicated at 96, a leverage system, generally indicated at 98, and a return mechanism, generally indicated at 168. The fluid control system 94 controls the in-flow and the out-flow of fluid, such as liquid, into the drive system 96 and, therefore, controls the lifting and raising of the seat 22. The drive system 96 transforms the fluid pressure into a mechanical linear force. The leverage system 98 transforms mechanical linear force into a torquing force applied to rotatable member 32. The return mechanism 168 supplies a force to lower seat 22 to its lowered position. In the preferred embodiment, the lifting power system 30 is located out of view, within the walls of bath 20. For easy access to the components of lifting power system 30, a removable outer panel 25, as best shown in FIGS. 4 and 5, is preferably incorporated into the bath 20. Other embodiments may place the lifting power system within the adjacent bathroom walls, or, if necessary, even expose such a system in the bathroom itself. Other alternative embodiments may even use other forms of lifting power systems that provide torque to rotatable member 32, for example, an electric motor.

As best shown in FIGS. 6 and 7, the fluid control system 94 of the preferred embodiment is made up of the following components: a feeder pipe 100, a control valve 102, a discharge pipe 104, a control knob 106, a needle valve 180, a needle valve adjustment mechanism 182, and a control pipe 108 between needle valve 180 and a chamber inlet 110. Feeder pipe 100 communicates fluid which lifts seat 22. The preferred embodiment, the fluid used is preferably water supplied under standard tap water pressure. However, it is contemplated that the fluid could be pressurized by a pump. Other alternative embodiments may use other forms of fluid control systems that control the flow of fluid into and out of fluid control system 94 or the drive system 96. Also, it is contemplated that other embodiments may utilize other fluids other than water, such as other liquids or even gaseous materials in place of tap water.

Control valve 102 controls the flow of fluid between feeder pipe 100 and control pipe 108. Control knob 106 operates control valve 102 to allow fluid to enter into, and exit from, the drive system 96 which, in turn, raises and lowers seat 22. Control pipe 108 communicates fluid into and out of drive system 96. Discharge pipe 104 empties fluid from drive system 96 into bath 20 by moving the control knob 106 so the control valve 102 is in the discharge position, as shown in FIG. 6. It is contemplated that the fluid control system 94 would be initially adjusted through the manipulation of needle valve adjustment mechanism 182, such that when control valve 102 is fully open the restricted setting of needle valve 180 would result in the bather descending at a comfortable rate of speed. It should be noted that control knob 106 can be moved such that control valve 102 is in misalignment with feeder pipe 100 and control pipe 108 allowing the operator to further control the volume of fluid entering or exiting pipe 108, and as a result, control the speed at which seat 22 rises or lowers. FIG. 7 shows control valve 102 in the lifting power position, where seat 22 would rise at its fastest rate. The diameter of control valve 102, feeder pipe 100, and/or control pipe 108, should be sized that the resulting seat movement moves at rate that is within a comfort level for bathers.

As best shown in FIGS. 6 and 7, drive system 96 comprises a chamber housing 111, a chamber 112, a piston rod 114, a piston head 116, a rod seal 118, a rod connector 120, a chamber housing mount 122, and a piston head seal 124. Chamber housing 111 defines chamber 112. Chamber 112 is filled and emptied of fluid from the fluid control system 94 causing piston head 116 to travel within chamber 112. Piston head 116 and piston head seal 124 provide a seal between the filled and unfilled portion of chamber 112. Chamber housing 111 is secured to bath 20 via chamber housing mount 122. Piston rod 114 is connected to piston head 116 and moves linearly with the movement of piston head 116. Rod seal 118 provides a seal about the piston rod 114 at the exit point of chamber 112. Rod connector 120 connects the piston rod 114 to the leverage system 98. In the preferred embodiment, as beat shown in FIG. 6, the travel distance B of piston head 116 is greater than the distance A traveled by seat 22, thus giving a leverage advantage to drive system 96 over seat 22. Other alternative embodiments are contemplated that may use other forms of drive systems to transform fluid pressure into mechanical energy.

Continuing with FIGS. 6 and 7, the leverage system 98 of the preferred embodiment comprises a pulley assembly 126, cam 128, cam cable 130, and cam cable connection 132. Pulley assembly 126 comprises a pulley wheel cable 134, pulley wheel 136, pulley wheel post 138, pulley body 140, pulley body cable connection 142, pulley wheel cable anchor 144, and anchor connection 146. Pulley wheel cable 134 is connected between rod connector 120 at the end of piston rod 114, and anchor connector 146 located on pulley wheel cable anchor 144. Pulley wheel cable 134 is looped about pulley wheel 136. Pulley wheel 136 is rotatably attached to pulley body 140 on pulley wheel post 138. Cam cable 130 is attached between pulley body 140 at the pulley body cable connection 142, and cam 128 at cam cable connection 132. Since cam 128 is fixedly attached about rotatable member 32, any movement of cam cable 130 results in the rotation of cam 128 which, in turn, rotates rotatable member 32 to move seat 22. Other alternative embodiments may utilize upper wall rod 82 as the rotatable member, with upper wall rod 82 only spanning between the wall connections and not extend into the side walls of the tub, and thus avoiding the need for any sealing means associated with opening 88 in the preferred embodiment since the upper wall rod is accessible above the water line of the bath. Yet, other alternative embodiments may use other forms of leverage systems which transform a supplied mechanical energy into rotational energy.

Still continuing with FIGS. 6 and 7, the return mechanism 168 of the preferred embodiment comprises a return cam 170, a spring 172, a return cam cable 174, a return cam cable connection 176, and a spring mooring 178. Spring 172 is connected at one end to spring mooring 178, and at the other, to return cam cable 174. Return cam cable 174 is, in turn, connected to return cam cable connection 176. Since return cam 170 is fixedly attached about rotatable member 32, any movement of return cam cable 174 results in the rotation of return cam 170 which, in turn, rotates rotatable member 32 to move seat 22. Other alternative embodiments may use other configurations to supply the force needed to return seat 22 to its lowered position, for example, a weight attached to seat 22, such that gravitational force provides the force necessary to lower the seat, or a torsional spring attached to rotatable member 32, such that rotational force urges the seat in the lowering direction. In addition, alternative embodiments may use springs of different sizes and strength or may use cams with a different radius. Yet, other alternative embodiments may utilize a single cam to perform both the functions of cam 128 and return cam 170.

USE AND OPERATION OF PREFERRED EMBODIMENT

A typical bather, being wheelchair assisted, would typically leave the bath system with seat 22 in its lowered position, as shown in FIG. 1. To transfer to the bath 20, bather wheels their chair along side of bath 20. The operator of the bath system then uses control knob 106 to initiate the flow of water from feeder pipe 100 through control pipe 108 into chamber 112. As water fills chamber 112, the water pressure forces piston head 116 along chamber 112 towards the bath wall 24C.

As shown in FIGS. 6 and 7, as piston head 116 travels along chamber 112, piston rod 114 and pulley wheel cable 134 move. Since pulley wheel cable 134 is threaded through pulley wheel 136 and anchored by pulley wheel cable anchor 144, the movement of pulley wheel cable 134 causes pulley wheel 136 to rotate and move in the same direction. The use of this leverage system 98 requires less force from the drive system 96 to lift seat 22. The movement of cam cable 130 causes cam 128, return cam 170, fixedly attached to rotatable member 32 to rotate. Return mechanism 168 is also set into motion with the movement of cam cable 130, however, its operation is essentially inconsequential while seat 22 is occupied with a bather, as the force supplied by return mechanism 168 is small in comparison to the weight of the bather. As shown in FIGS. 4 and 5, as rotatable member 32 rotates, guiding assembly 26, moves seat 22 in a smooth fashion along a straight line path from its central location at or near the longitudinal axis D of the bath bottom 24E, as best shown in FIG. 3, to a location, as best shown in FIG. 5, where the side of seat 22 is at or beyond the top of side wall 24D. The angle Ø of the path is preferably between 10° and 20° from the orthogonal of the bath bottom 24E. Preferably Ø is 15°. In so moving, the arm sets 34A, 34B and 80A, 80B of guiding assembly 26 move in unison from a position pointing substantially towards the bottom 24E of bath 20 to a position pointing substantially away from the bottom 24E of bath 20 to raise connected seat bottom 22A above the top of bath 20.

In it fully raised position, seat 22 is at or beyond the top of the side wall 24D of bath 20, so that bather can transfer to seat 22. To transfer to seat 22, the bather maneuvers his or her wheelchair so that it is substantially parallel to the bath and next to the seat 22. The bather then slides off the chair onto the ledge of bath 20 and/or, if capable, directly onto seat 22. Then, the bather brings the bather's legs over side wall 24D and into bath 20.

As best shown in FIGS. 4, 5 and 6, and discussed above, once securely in seat 22, control knob 106 is operated to release the water from chamber 112 and lower the bather into bath 20. The discharged water travels through control pipe 108 and discharge pipe 104 into bath 20. D ig this process, seat 22, guiding assembly 26, lifting device 28, and lifting power system 30, all reverse direction. During the lowering mode, the bather sitting on the seat 22 experiences a constant and smooth descent along a straight line path away from the side 24D of bath 20, towards the central position longitudinal axis D of the bath bottom 24E. When seat 22 has been properly lowered, the bather can begin bathing. The filling of the bath with bath water may be done at any point before, during or after this process, or, if a shower is desired, may not be filled at all. If the seat 22 is used in conjunction with a shower, the seat may be stopped in any desired position along the path that seat 22 travels. Allowing the operator to choose to stop seat 22 in any location along the path of seat 22, the bather can choose the most comfortable position. For example, the bather may want the seat slightly elevated while taking a shower as compared to the lowest position to be more fully submerged while taking a bath. To stop the seat in any position along the path traveled by seat 22, the operator need only position control knob 106 such that control valve 102 is in a position that it does not communicate control pipe 108 to either discharge pipe 104 or feeder pipe 100.

To allow the bather to exit bath 20, the operator simply follows the steps describing earlier to position the seat for transfer. However, now the operator operates the control knob 106 while the bather is in seat 22. The operator and bather can be different or the same person. While exiting bath 20, seat 22 ascends smoothly, in one continuous straight line movement, along a proportional angular path, from the lowered position at or near the longitudinal axis D of the bath bottom 24E, to a raised position at or above the side of bath 20. Once fully raised, the bather reverses his/her earlier movements to transfer back into the wheelchair. Once in the chair, the operator would use control knob 106 to return the seat 22 to its lowered position. To lower the unoccupied seat 22, the operator simply follows the steps described earlier for lowering the seat. However, with the absence of a bather from seat 22, the additional force generated by return mechanism 168 assist the return of seat 22, guiding assembly 26, lifting device 28, and lifting power system 30 to their respective positions when seat 22 is in its fully lowered position.

Rotation assembly 40 allows for the rotation of seat 22 at a location above the top of bath 20. The operation of is mechanism has not been described, but may be usefull for bathers. It is contemplated that bathers, not in wheelchairs, could mount the seat 22 when rotated to face the side of the bath, as shown in phantom view in 5 FIGS. 3 and 5.

ALTERNATIVE EMBODIMENT A

Turning now to the alternative embodiment A shown in FIGS. 10–11, the alternative embodiment A utilizes similar component parts to the preferred embodiment, including bath 20, seat 22 and guiding assembly, but includes an alternative bellows member 148. The bellows member 148 includes an upper connector ring 150, a lower connector ring 152, a bellows casing 154, and a bellows inlet member 156. This alternative embodiment includes the additional feature of bellows recess 158 in the bath bottom 24E. The bellows recess 158 provides adequate space below the seat when the bellows is in its compressed mode. The presence of tbellows recess 158 may require a deeper channel recess 38 communicating between bellows recess 158 and the drain opening 24F, or alternatively another drain opening could be provided in bellows recess 158. Other embodiments may use a different recess formation or may have no recess formations at all.

Bellows casing 154 is attached between the seat bottom 22A and the bottom 24E of bath 20 via upper ring 150 and lower ring 152. The lower ring 152 is located within bellows recess 158. Bellows inlet member 156 allows for fluid to move between the fluid control system 94 including the needle valve 180 (not shown in FIGS. 10 and 11), as previously described, and bellows member 148. As the bellows member 148 fills with a fluid, the bellows member 148 expands and raises seat 22. Guiding assembly 26 controls the direction that seat 22 moves, as movement is imparted to seat 22 by expanding bellows member 148. Here, unlike the preferred embodiment, rotatable member 32 ig a passive rotatable member, that does not need to extend through any bath wall, like the other above-described guiding assembly rods 82, 84 and 86. With this exception, the guiding assembly, in this alternative embodiment, is essentially the same as the one in the preferred embodiment. Other embodiments may use other guiding assemblies, such as, the use of a simple guide pole or poles that extend from the walls of the bath. Such a pole might be disposed within the bellows member 148 itself. Other embodiments may follow a path other than the described angular path, for example, the seat may rise at a 90° angle to the bottom 24E and, therefore, not have any lateral movement. Other embodiments may also place the bellows member 148 in a location other than below seat 22. For example, the bellows may instead contact a guiding assembly connected to the seat, which, in turn, causes seat 22 to move. In addition, other embodiments may use other forms of an expandable member, which when expanded, causes the raising of seat 22, for example, a balloon type member.

USE AND OPERATION OF ALTERNATIVE EMBODIMENT A;

The bather mounts and dismounts seat 22 in the same manner as described in the preferred embodiment. However, as best shown in FIGS. 10 and 11 to raise seat 22, an operator uses control knob 106 to initiate the flow of fluid, such as water, from feeder pipe 100 through control pipe 108 into alternative bellows member 148. As water fills bellows member 148, the water pressure expands bellows member 148.

As bellows member 148 expands, it pushes against seat 22 and moves seat 22 away from the bottom 24E of bath 20. Guiding assembly 26 guides seat 22 along a smooth and continuous straight line proportional angular path from the longitudinal axis D of bath bottom 24E, to a location where the side of seat 22 is at or beyond the top of side wall 24D. In so moving, the set of arms 34A, 34B and 80A, 80B of guiding assembly 26 move in unison from a position pointing substantially towards the bottom of bath 20 to a position pointing substantially away from the bottom 24E of bath 20, and raise seat bottom 22A above the top of bath 20.

To lower seat 22, the operator moves control knob 106 to release water from bellows member 148 to discharge pipe 104 into the bath. The weighted seat 22, or, in case a bather is located thereon, the weight of a bather and the seat, on bellows member 148 urges the water within bellows member 149 to be discharged into control pipe 108, through control valve 102 to discharge pipe 104 into bath 20. During the lowering mode, seat 22 experiences a constant and smooth straight line decent along a proportional angular path away from the side 24D of bath 20, towards at or near the longitudinal axis D of the bath bottom 24E.

ALTERNATIVE EMBODIMENT B

Turning now to the alternative embodiment B shown in FIG. 12, the alternative embodiment B utilizes similar component parts as those found in the preferred embodiment except that lifting power system 30 is significantly altered. Although the fluid control system 94 and the return mechanism 168 have remained very similar to those in the preferred embodiment, the drive system 96 and the leverage mechanism 98 of the preferred embodiment have been replaced with a lifting power system comprising a power piston system 184 and power cam system 186, respectively.

The power piston system 184 comprises a power piston housing 188, a power piston chamber 190, a power piston rod 192, a power piston head 194, a power piston rod seal 196, a power piston rod connector 198, a power piston housing mount 200, and a power piston head seal 202. A power piston housing 188 defines power piston chamber 190. Power piston chamber 190 is filled and emptied of fluid from the fluid control system 94, tough power inlet member 210, causing power piston head 194 to travel within power piston chamber 190. Power piston head 194 and power piston head seal 202 provide a seal between the filled and unfilled portion of power piston chamber 190. Power piston chamber 190 is secured to bath 20 via power piston housing mount 200. Power piston rod 192 is connected to power piston head 194 and moves linearly with the movement of power piston head 194. Power piston rod seal 196 provides a seal about the power piston rod 192 at the exit point of power piston chamber 190. Power piston rod connector 198 connects power piston rod 192 directly to the cam system 186 via power cam cable 204.

USE AND OPERATION OF ALTERNATIVE EMBODIMENT B

The operation of alternative embodiment B is similar to that of the preferred embodiment. However, power cam cable 204 is instead connected directly between power piston rod connector 198 and power cam connector 206, eliminating pulley assembly 126 of the preferred embodiment. Rather than using a pulley assembly 126 to provide leverage to the force supplied by power piston system 184, power cam cable 204 provides a direct connection between power piston system 184 and power cam system 186. As shown in FIG. 12, as power piston head 194 travels along power piston chamber 190, power piston rod 192 and power cam cable 204 move along a linear path. The movement of power cam cable 204 causes both power cam 208 and fixedly attached rotatable member 32 to rotate. This rotation, as described in the preferred embodiment, results in the lifting movement of seat 22.

The foregoing disclosure and description are illustrative and explanatory thereof, and various changes in the size, shape, and materials, as well as in the details of illustrative construction and assembly, may be made without departing from the spirit of the invention.

What is claimed is:

1. System for moving a seat in a bath having a side wall and a wall behind the seat, comprising:

a guiding assembly disposed within the bath, wherein the guiding assembly comprises a first arm pivotally connected between the bath wall behind the seat and the seat and a lifting device for moving the seat between a raised and a lowered position, wherein said lifting device comprises at least one rotatable member for moving said first arm to move the seat to the raised position and the side wall having at least one opening and said rotatable member is positioned through said side wall opening;

wherein the guiding assembly guides the seat in a straight line form a lowered position to a raised laterally offset position form the lowered position.

2. System of claim 1 wherein the guiding assembly further comprises:

a second arm pivotally connected between the wall behind the seat and the seat.

3. System of claim 1 wherein the seat substantially covers said guiding assembly.

4. System of claim 1 wherein the seat substantially covers said lifting device.

5. System of claims 1 wherein said rotatable member being sealed within said side wall opening.

6. System of claim 1 wherein the seat is cantilevered from the bath wall behind the seat.

7. System of claim 1 wherein the lifting device is disposed uwithin the bath.

8. System of claim 1 wherein the seat moves at an angle between 10° and 20° from the orthogonal of the bottom of the bath.

9. System for moving a seat in a bath, the bath having a side wall and a wall behind the seat, comprising:

a guiding assembly disposed within the bath and pivotably attached to the wall behind the seat, the guiding assembly moves in a straight line from a lowered position to a raised laterally offset position from the lowered position towards the side wall of the bath;

a lifting device for moving the seat between a raised angle a lowered position;

wherein the guiding assembly pivotally guides the seat in a straight line form a lowered position to a raised laterally offset position from the lowered position towards the side wall of the bath.

10. System of claim 9 wherein the guiding assembly comprises:

a first arm pivotally connected between the wall behind the seat and the seat.

11. System of claim 10 wherein the guiding assembly further comprises:

a second arm pivotally corrected between the wall behind the seat and the seat.

12. System of claim 10 wherein said lifting device comprises at least; one rotatable member for moving said first arm to move the seat to the raised position.

13. System of claim 12 wherein the side wall having at least one opening and said rotatable member positioned through the side wall opening.

14. System of claim 13 wherein said rotatable member being sealed within the side wall opening.

15. System of claim 9 wherein the seat substantially covers said guiding assembly.

16. System of claim 9 wherein the seat substantially converts said lifting device.

17. System of claim 9 wherein the seat is cantilevered from the wall behind the seat.

18. System of claim 9 wherein the lifting device is disposed within the bath.

19. System of claim 9 wherein the seat moves at a angle between 10° and 20° from the orthogonal of the bottom of the bath.

20. System for moving a seat in a bath, the bath having a side wall and a wall behind the seat, comprising:

a guiding assembly disposed within the bath and pivotably attached to the wall behind the seat, the guiding assembly moves in a straight line from a lowered position to a raised laterally offset position from the lowered position towards the side wall of the bath;

a lifting device for moving the seat between a raised and a lowered position;

wherein the guiding assembly comprises a first arm pivotally connected between the wall behind the seat and the seat, and the guiding assembly pivotally guides the seat in a straight line from a lowered position to a raised laterally offset position from the lowered position towards the side wall of the bath; and said lifting device, comprises at least one rotatable member positioned through an opening in the side wall for moving said first arm to move the seat to the raised position.

21. System of claim 20 wherein the seat moves at an angle between 10° and 20° from the orthogonal of the bottom of the bath.

22. System of claim 20 wherein the guiding assembly further comprises: a second arm pivotally connected between the wall behind the seat and the seat.

23. System of claim 20 wherein the seat substantially covers said guiding assembly.

24. System of claim 20 wherein the seat substantially covers said lifting device.

25. System of claim 20 wherein said rotatable member being sealed within the side wall opening.

26. System of claim 20 wherein the seat is cantilevered from the wall behind the seat.

27. System of claim 20 wherein the lifting device is disposed witbin the bath.

* * * * *

UNITED STATES PATENT AND TRADEMARK OFFICE

CERTIFICATE OF CORRECTION

PATENT NO. : 6,397,409 B1 
DATED : June 4, 2002
INVENTOR(S) : Mary F. Sherlock and Rainer Kuenzel It is certified that error appears in the above-identified patent and that said Letters Patent is hereby corrected as shown below:

Title page,
Item [75], Inventors, delete "John R. Schubert, Kerrville".

Column 1,
Line 59, delete "In. 62" and replace with -- ln. 62 -- (changing the "I" to an "L").

Column 2,
Line 33, delete "alga sown" and replace with -- also shown --.

Column 4,
Line 16, delete "fall" and replace with -- full --; and
Line 31, delete number "0" and replace with the symbol -- Ø --.

Column 5,
Line 64, delete "beat" and replace with -- best --.

Column 7,
Line 25, delete "it" and replace with -- its --; and
Line 34, delete "D ig" and replace with -- During --.

Column 8,
Line 14, delete "is" and replace with -- this --;
Line 15, delete "usefull" and replace with -- useful --;
Line 18, delete the "5" immediately before "FIGS. 3 and 5";
Line 30, delete "tbellows" and replace with -- bellows --; and
Line 49, delete "ig" and replace with -- is --.

Column 9,
Line 2, delete the semicolon ";" after "A" and replace with a colon -- : --;
Line 5, insert a comma -- , -- immediately after "11";
Line 27, delete "149" and replace with -- 148 --;
Line 33, insert a colon -- : -- immediately after "B";
Line 51, delete "tough" and replace with -- through --; and
Line 65, insert a colon -- : -- immediately after "B".

UNITED STATES PATENT AND TRADEMARK OFFICE

CERTIFICATE OF CORRECTION

PATENT NO. : 6,397,409 B1 
DATED : June 4, 2002
INVENTOR(S) : Mary F. Sherlock and Rainer Kuenzel It is certified that error appears in the above-identified patent and that said Letters Patent is hereby corrected as shown below:

Column 10,
Lines 34 and 35, delete “form” and replace with -- from --;
Line 44, delete “claims” and replace with -- claim --;
Line 49, delete “uwithin” and replace with -- within --;
Lines 55-56, delete “pivotably” and replace with -- pivotally --;
Line 60, delete “angle” and replace with -- and --;
Line 63, delete “form” and replace with -- from --;

Column 11,
Line 7, delete “corrected” and replace with -- connected --;
Line 10, delete seimcolon “;” after “least”;
Line 20, delete “converts” and replace with -- covers --;
Line 25, delete “a” and replace with -- an --;
Lines 30-31, delete “pivotably” and replace with -- pivotally --; and
Line 29, delete “witbin” and replace with -- within --.

Signed and Sealed this

Twenty-third Day of September, 2003

JAMES E. ROGAN
*Director of the United States Patent and Trademark Office*